US010660396B2

(12) United States Patent
Gong et al.

(10) Patent No.: US 10,660,396 B2
(45) Date of Patent: May 26, 2020

(54) SPORTS SHOES

(71) Applicant: HUNAN NORMAL UNIVERSITY, Changsha (CN)

(72) Inventors: Tao Gong, Changsha (CN); Jianshe Zhou, Changsha (CN)

( * ) Notice: Subject to any disclaimer, the term of this patent is extended or adjusted under 35 U.S.C. 154(b) by 48 days.

(21) Appl. No.: 16/008,034

(22) Filed: Jun. 14, 2018

(65) Prior Publication Data

US 2018/0289097 A1 Oct. 11, 2018

Related U.S. Application Data

(63) Continuation of application No. PCT/CN2016/110433, filed on Dec. 16, 2016.

(51) Int. Cl.

| | |
|---|---|
| ***A43B 3/00*** | (2006.01) |
| ***A43B 7/08*** | (2006.01) |
| ***A47G 25/00*** | (2006.01) |
| ***A47G 9/10*** | (2006.01) |
| ***A43B 7/00*** | (2006.01) |

(Continued)

(52) U.S. Cl.

CPC ..... *A43B 3/0015* (2013.01); *A43B 3/00* (2013.01); *A43B 3/0005* (2013.01); *A43B 3/0047* (2013.01); *A43B 7/00* (2013.01); *A43B 7/08* (2013.01); *A43B 7/081* (2013.01); *A43B 7/088* (2013.01); *A47G 9/1045* (2013.01);

(Continued)

(58) Field of Classification Search

CPC ..... A43B 3/0015; A43B 3/0005; A43B 3/00; A43B 7/081; A43B 7/08; A43B 7/088; A43B 7/00

See application file for complete search history.

(56) References Cited

U.S. PATENT DOCUMENTS 7,107,706 B1 * 9/2006 Bailey, Sr. ..... A43B 3/0005 36/29

7,395,615 B2 7/2008 Lee (Continued)

FOREIGN PATENT DOCUMENTS

CN 2653923 Y 11/2004
CN 1895116 A 1/2007

(Continued)

OTHER PUBLICATIONS

International Search Report O PCT/CN2016/110433 dated Mar. 1, 2017.

*Primary Examiner* — Ted Kavanaugh
(74) *Attorney, Agent, or Firm* — W&K IP

(57) ABSTRACT

The invention discloses a pair of sports shoes comprising a shoes body, a pressure generating device, a humidity sensor, a controller and a switch valve. A shoes chamber is provided at the heel of the shoes body, and the pressure generating device is arranged in the groove chamber. The upper work end of the pressure generating device is in contact with the lower surface of the insole of the shoes body; the humidity sensor is setted at the upper surface of the insole of the shoes body; the humidity sensor, the controller and the switch valve are electrically connected in turn, and the pressure generating device supplies power to the humidity sensor, the controller, and the switch valve, respectively; the controller controls the pressure generating device to stop or start energizing the solenoid valve tongue of the switch valve to close or conduct the gas passage.

10 Claims, 9 Drawing Sheets

(51) Int. Cl.
*A43B 5/00* (2006.01)
*A43B 17/10* (2006.01)

(52) U.S. Cl.
CPC ..... *A47G 25/005* (2013.01); *A43B 3/0094* (2013.01); *A43B 5/00* (2013.01); *A43B 17/10* (2013.01)

(56) References Cited

U.S. PATENT DOCUMENTS

| | | | | |
|---|---|---|---|---|
| 2002/0050074 | A1* | 5/2002 | Ricco | A43B 7/02 36/3 R |
| 2006/0196081 | A1 | 9/2006 | Lee | |
| 2009/0084001 | A1* | 4/2009 | Sgattoni | A43B 7/081 36/3 A |
| 2011/0056092 | A1* | 3/2011 | Tsiantos | A43B 1/0045 36/103 |
| 2012/0216432 | A1* | 8/2012 | Byrne | A43B 7/081 36/3 B |

FOREIGN PATENT DOCUMENTS

| | | | |
|---|---|---|---|
| CN | 204273392 | U | 4/2015 |
| CN | 105394872 | A | 3/2016 |
| CN | 205233604 | U | 5/2016 |
| JP | 2007296263 | A | 11/2007 |

* cited by examiner

SPORTS SHOES

CROSS-REFERENCE TO RELATED APPLICATIONS

This application is a continuation of International Patent Application No. PCT/CN2016/110433 with a filing date of Dec. 16, 2016, designating the United States, now pending, and further claims priority to Chinese Patent Application No. 201510956108.2 with a filing date of Dec. 17, 2015. The content of the aforementioned applications, including any intervening amendments thereto, are incorporated herein by reference.

TECHNICAL FIELD

The present invention relates to sports equipment, and more particularly to a pair of sports shoes having an automatic adjusting function.

BACKGROUND OF THE PRESENT INVENTION

With the development of electronic technology, more and more technological elements have been added to sports shoes, such as sports shoes that can produce acousto-optic effects. Many shoes manufacturer choose to add more entertainment elements to sports shoes, result in higher price and lower practice value.

In order to solve the problem of heat dissipation and perspiration in the foot under high-volume exercise, mesh fabrics and other heat-dissipating materials are often used in sports shoes. However, due to the environment and personal constitution, the demand for heat dissipation and perspiration may be vary from different sports shoes users. For example, in a sweltering environment, our feet is easier to get sweating, especially in the part of midfoot. Therefore, how to meet the different needs of different physiques under different circumstances and provide more personalized in-shoes environmental conditioning is particularly important.

SUMMARY OF PRESENT INVENTION

The purpose of the present invention is to provide a pair of sports shoes that allow the shoes body to have a better automatic adjustment function so as to solve the different needs of people of different physiques in different environments.

Based on the above objective, the present invention provides a pair of sports shoes, comprising a shoes body, a pressure generating device, a humidity sensor, a controller, and a switch valve;

A shoes chamber is provided at a heel portion of the shoes body, the pressure generating device is arranged in the groove chamber, and the upper work end of the pressure generating device is in contact with the lower surface of the insole of the shoes body.

A first mesh-shaped opening is provided at the back of the heel of the shoes body, a first channel is opened between the trough chamber and the first opening at the back of the heel, and the insole of the shoes body is opened. A second opening is formed on the upper surface of the arch portion, a mesh is provided at a corresponding position of the second opening of the shoes insole, and a second channel is opened from the trough chamber to the second opening; The channel is conducted through the slot chamber and the second channel so that the outside air can enter into the shoes through the back of the heel;

In the second passage, the switch valve is disposed perpendicularly across the second passage. The switch valve includes a solenoid valve tongue, a magnetic valve seat, and a spring mechanism. The solenoid valve tongue and the spring mechanism are disposed on the switch valve. On one side of the second passage, the magnetic valve seat is located on the opposite side. Under the state that the electromagnetic valve tongue is powered off, the electromagnetic valve tongue is pressed against the magnetic valve seat side by the spring mechanism. The tongue of the electromagnetic valve blocks the second passage, so that the second passage is closed. Under the energized state of the electromagnetic valve tongue, the magnetic valve tongue is the same as the magnetic pole of the magnetic valve seat and receives the magnetic force. The repulsive force between the valve seats is retracted to a side away from the magnetic valve seat, so that the second passage is conducted;

The inner bottom of the shoes body is provided with the humidity sensor near the upper surface of the second opening, and the controller is disposed in the tank chamber; the humidity sensor, the controller and the switch valve are electrically connected in turn, and the pressure generating device supplies power to the humidity sensor, controller and switch valve, respectively; under normal circumstances, the controller controls the pressure generating device to stop supplying power to the solenoid valve tongue of the switch valve, enabling the second channel closed; the humidity sensor detects ambient humidity changes, and sends the humidity detection result to the controller, the controller determines in real time whether the humidity value exceeds a threshold, if the threshold is exceeded, the controller controls the pressure generating device. The solenoid valve of the switch valve is opened to power the second channel.

Optionally, an anion generator is disposed on the top of the tongue of the electromagnetic valve in the sports shoes, and the magnetic valve seat is annular;

The controller controls the pressure generating device to turn on the solenoid valve tongue of the switch valve, the power supply of the negative ion generator is turned on at the same time, and the magnetic valve tongue is the same as the magnetic pole of the magnetic valve seat. When the repulsive force between the magnetic valve seat is retracted to the side remote from the magnetic valve seat, the negative ion generator is in the second passage;

The controller controls the pressure generating device to stop powering the solenoid valve tongue of the switch valve, the power supply of the negative ion generator is stopped simultaneously, and the solenoid valve tongue is pressed against the magnetic valve by the spring mechanism on one side of the seat, the negative ion generator is forced into the annular center hole of the magnetic valve seat.

Optionally, the first opening in the sports shoes is flared, the inner diameter gradually increases from the first channel to the back of the heel, and the inner surface of the first opening is a Coanda surface;

A third opening between the second channel and the chamber is flared, a diameter gradually increases from the second channel to the chamber, and a third opening is formed between the second channel and the chamber. The inner surface is a Coanda surface.

Optionally, in the sports shoes, a fourth opening between the first channel and the trough chamber gradually shrinks from the first channel to the trough chamber;

The second opening is flared, the inner diameter of the upper surface extending from the second passage to the insole portion gradually increases, and the inner surface of the second opening is the Coanda surface.

Optionally, a spiral slot line is provided inside the second channel in the sports shoes.

Optionally, the pressure generating device and the controller in the sports shoes are placed in a waterproof protective sleeve, and the bottom is fixedly connected with the bottom of the tank interior;

The insole of the shoes body includes an insulating layer and an exposed layer, the insulating layer is disposed under the exposed layer, and the insulating layer and the exposed layer have the same size.

Optionally, the pressure generating device in the sports shoes includes a pressure generating module, a rectifier circuit, a capacitor, and a voltage regulator circuit module that are connected in sequence.

Optionally, the pressure generating device in the sports shoes further includes a battery, the battery includes an energy storage and discharge circuit and a lithium battery, and the energy storage and discharge circuit is electrically connected with a voltage stabilization circuit module and a lithium battery, respectively. The energy storage and discharge circuit is used for storing electrical energy in a lithium battery and supplying the stored electrical energy to the controller, switch valve, and humidity sensor.

Optionally, in the sports shoes, the controller controls the pressure generating device to turn on the power of the electromagnetic valve tongue of the switch valve, and after the second channel is turned on, the controller further includes: if the controller determines the humidity value, below the threshold, it is further determined whether the difference between the current humidity value and the threshold is less than a predetermined amount. If yes, the controller controls the pressure generating device to stop supplying power to the solenoid valve tongue of the switch valve. The second channel is closed.

Optionally, in the sports shoes, a cross-section trapezoid is formed at the front edge of one shoes body, and the front edge of the other shoes body is surrounded by a trapezoidal cross-section that matches the shape of the inverted trapezoidal cross-section. A convex groove-shaped slide rail; the inverted trapezoidal convex flange can be inserted into the trapezoidal convex groove from the side of the shoes body, and can slide in the convex groove-shaped slide rail, so that the front of the two shoes bodies connected.

It can be seen from the above description that the sports shoes provided by the present invention detects the humidity change of the shoes body through a humidity sensor, and controls the on-off valve of the ventilation passage to adjust the air circulation volume of the shoes body through the controller so as to play a role in the shoes interior environment. The self-contained pressure generating device not only does not require external power supply to charge or replace the battery, it can also solve the power supply problem of the electronic components within the shoes. There is no need to replace the battery or reserve the charging interface, so that the shoes body seal better while the endurance function has also been well solved; in addition, by installing the pressure generating device in the inner tank of the heel and through the design of the ventilation passage, the user can automatically convert the exercise energy into electric energy during the exercise. The pressure generating and restoring actions of the power generating device cause the trough chamber to be deformed to drive the air flow of the two ventilation passages so as to achieve a better air flow regulating effect on the shoes cavity and the first passage to the trough chamber. The airflow injection also plays a role in the heat dissipation of electronic components such as pressure generating devices and controllers. Meticulously crafted, it takes more than one thing.

DETAILED DESCRIPTION OF PREFERRED EMBODIMENTS

To make the objectives, technical solutions, and advantages of the present invention more comprehensible, the following further describes the present invention in detail with reference to specific embodiments and with reference to the accompanying drawings.

Since sports shoes are often used for large-volume exercise activities, it is necessary to effectively adjust the inner cavity environment of the shoes to ensure that the shoes are comfortable to wear. In addition, outdoor sports for athletic shoes should also consider its all-weather adaptability.

Figure 1:
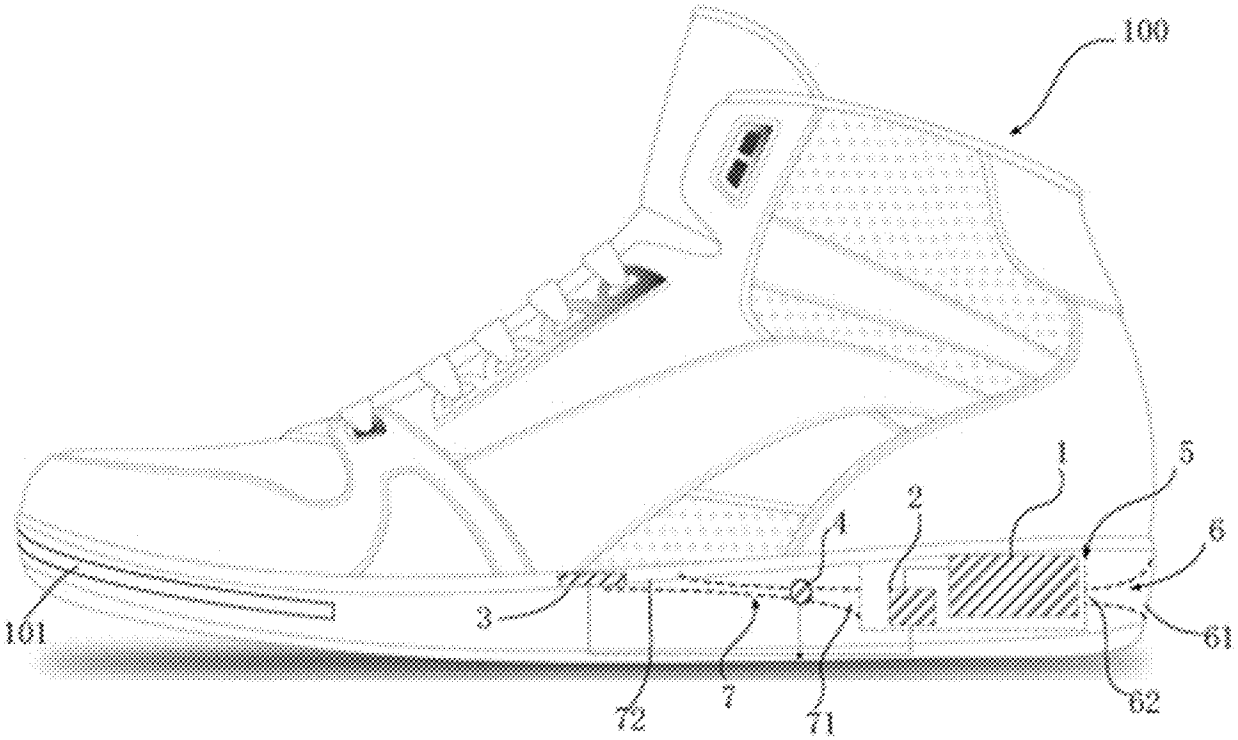
FIG. 1 is a schematic structural view of the sports shoes according to an embodiment of the present invention.

For this purpose, as an embodiment, a sports shoes provided by the present invention, as shown in FIG. 1, includes a shoes body 100, a pressure generating device 1, a controller 2, a humidity sensor 3, and a switch valve 4;

A shoes chamber 5 is provided at the heel portion of the shoes body 100. The pressure generating device 1 is disposed in the tank chamber 5, and the upper work end of the pressure power generating device 1 is in contact with the lower surface of the insole of the shoes body.

Figure 2:
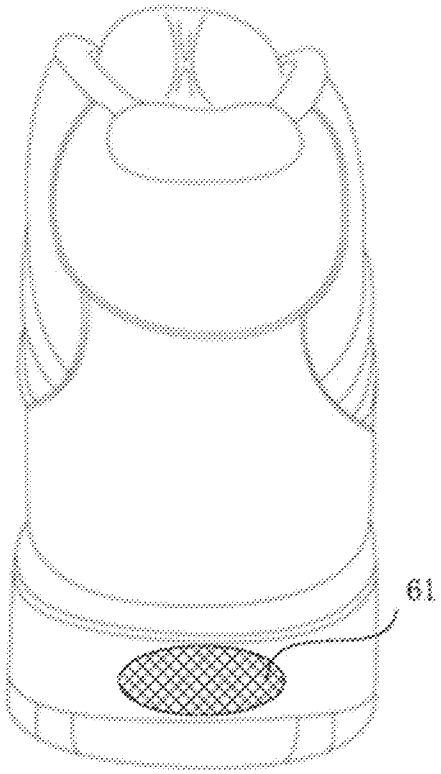
FIG. 2 is a right side view of the sports shoes according to an embodiment of the present invention.
Figure 3:
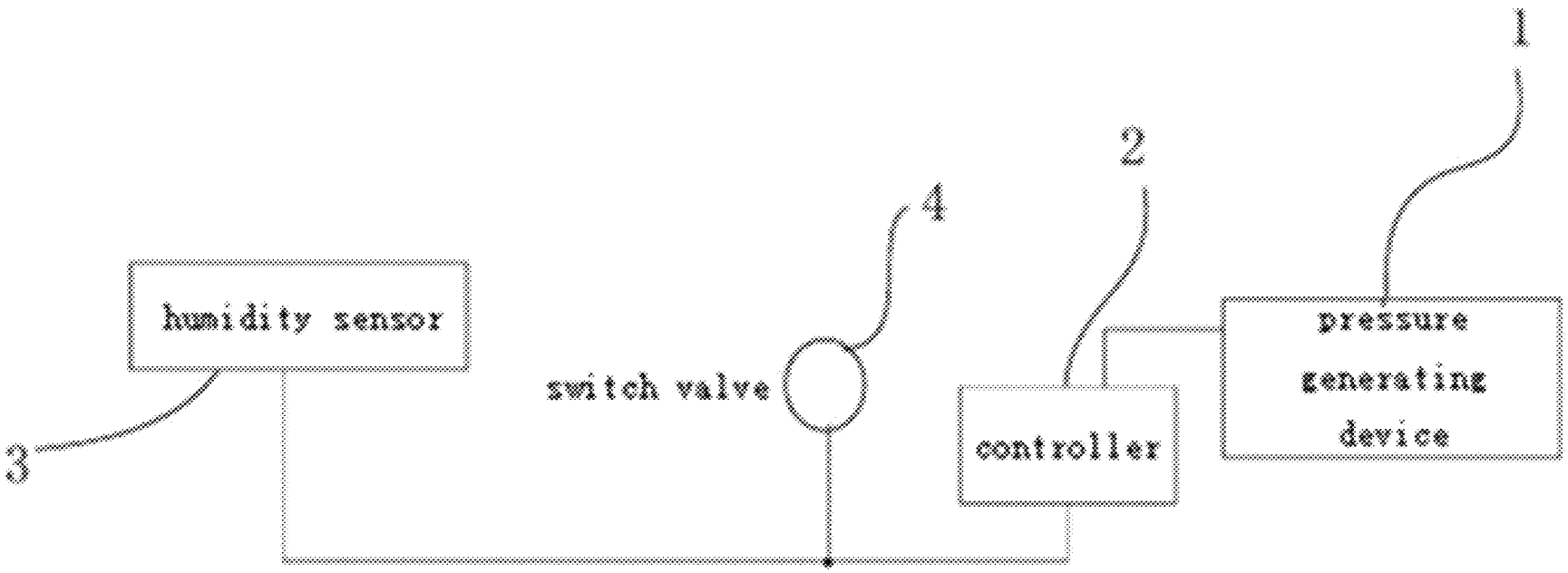
FIG. 3 is a schematic structural view of a circuit part of the sports shoes according to an embodiment of the present invention.
Figure 4:
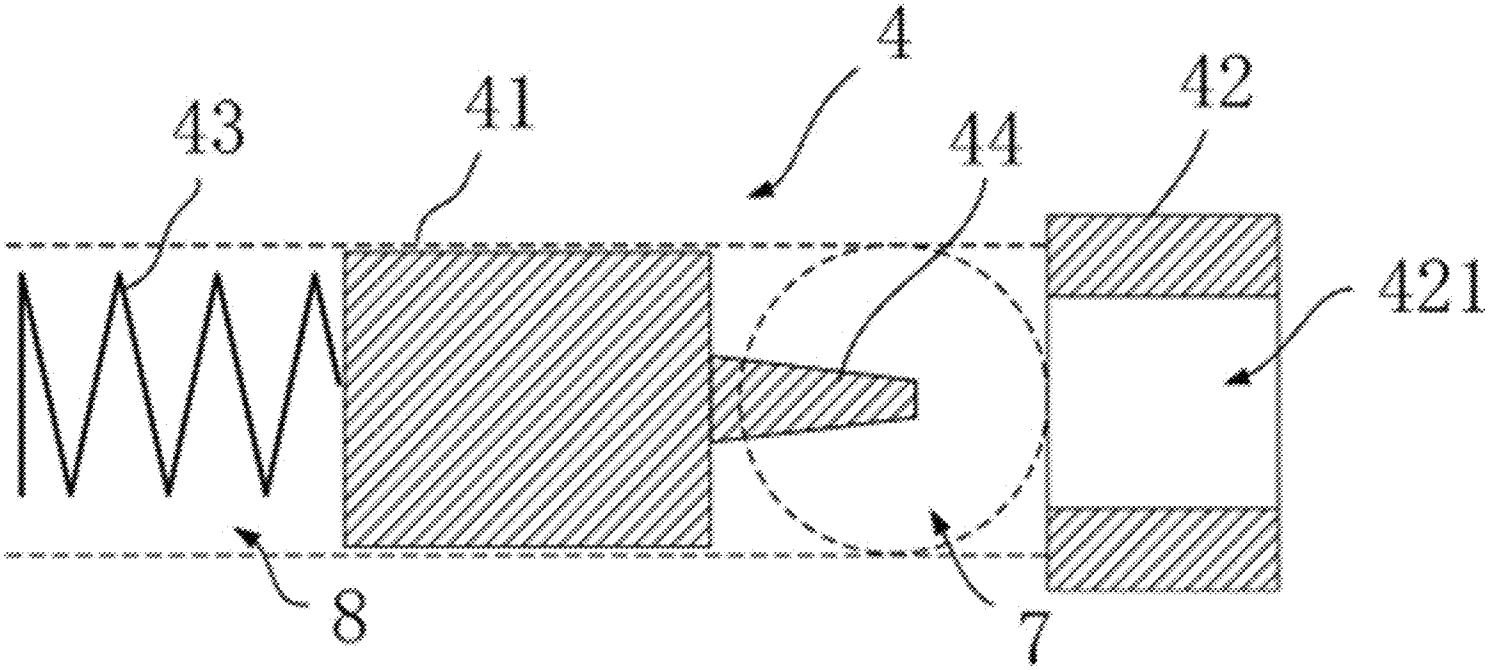
FIG. 4 is a schematic view of an open state of a switch valve according to an embodiment of the present invention.

A heel-shaped first opening 61 (shown in FIG. 2) is provided at the rear of the heel of the shoes body 100, and a first passage is defined between the groove chamber and the first opening 61 of the heel rear portion 6; The insole of the shoes body starts to have a second opening 72 at the upper surface of the arch area, and the insole of the shoes body is provided with a mesh at a corresponding position of the second opening 72, and between trough chamber 5 and second opening 72 is provided with a second channel 7; the first channel 6 is conducted through the slot chamber 5 and the second channel 7, so that outside air can enter into the shoes through the back of the heel;

On the second passage 7, the on-off valve 4 is provided to cross the second passage 7 vertically. Referring to FIGS. 3 and 4, the switch valve 4 includes a solenoid valve tongue 41, a magnetic valve seat 42, and a spring mechanism 43. The solenoid valve tongue 41 and the spring mechanism 43 are disposed on one side of the second channel 7. The magnetic valve seat 42 is located on the opposite side. When the electromagnetic valve tongue 41 is powered off, the electromagnetic valve tongue 41 is pressed against the magnetic valve seat 42 by the spring mechanism 43. The tongue 41 blocks the second passage 7 and closes the second passage 7. Under the energized state of the electromagnetic valve tongue 41, the magnetic valve tongue 41 is the same as the magnetic pole of the magnetic valve seat 42, and receives the repulsive force between the magnetic valve seat 42 is retracted to the side away from the magnetic valve seat 42 to make the second passage 7 conductive;

The inner surface of the shoes body 100 is provided with the humidity sensor 3 near the upper surface of the second opening 72. The controller 2 is disposed in the tank chamber 5. As shown in FIG. 3, the humidity sensor 3, the controller 2 and the switch valve 4 are electrically connected in turn, and the pressure generating device 1 supplies power to the humidity sensor 3, the controller 2 and the switch valve 4, respectively; under normal conditions The controller 2 controls the pressure generating device 1 to stop supplying power to the electromagnetic valve tongue 41 of the switch valve 4 to close the second channel 7; the humidity sensor 3 detects the change of the surrounding humidity and detects the humidity. The result is sent to the controller 2, and the controller 2 determines whether the humidity value exceeds the threshold in real time. If the threshold is exceeded, the controller 2 controls the pressure generating device 1 to open the electromagnetic valve tongue of the switch valve 4. Power supply 41 causes the second channel 7 to conduct.

The meshes of the first opening and the second opening are realized by covering the mesh fabric, the mesh size of the first opening mesh fabric does not exceed 0.1 mm, and the mesh size of the second opening mesh fabric may be larger than 0.1-0.5 mm. Preferably, the first opening mesh fabric has a pore size of 0.035-0.08 mm, and the second opening mesh fabric has a pore size of between 0.15-0.25 mm.

In the above solution, through the design of the first channel 6 and the second channel 7 in the middle of the heel and the sole, external air can be delivered to the arch and the sole of the foot, which is the most likely to perspire in the shoes cavity. The pressure generating device 1 is arranged on the heel portion so that during the movement, most of the load can be stepped on and the heel portion is stepped on. At the same time, electric energy is output. The electric energy has a controller to control the opening and closing of the on/off valve 4 on the second channel 7, and the judgment of the opening and closing is located by The detection of humidity in the shoes cavity is determined by the humidity sensor 3 in the sole or arch area. According to the investigation of sweating in the foot of a shoes, it is a phenomenon that the user cannot tolerate the environment inside the shoes. For this purpose, adjusting the humidity inside the shoes cavity is the most effective method. In addition, the humidity sensor is located in the second opening position of the second passage, which is covered with a mesh fabric and does not block the moist air. At the same time, the position of the humidity sensor is the most easily sweated part of the foot, so it can be reached sensitively and effectively. The effect of humidity monitoring in the shoes cavity. At the same time, due to the action of pressure generation and recovery of the power generating device, the trough chamber is deformed to drive the air flow of the two ventilation channels, thereby achieving a better air flow regulating effect on the shoes cavity and using the first channel. Injecting air into the chamber also serves to dissipate heat from electronic components such as pressure generating devices and controllers. The self-generation of the body of the shoes avoids the troubles of replacing the battery or charging, and effectively guarantees the endurance of the shoes body, and at the same time avoids the reserve of the battery box cover or the charging hole on the surface of the shoes body and the surface of the shoes cavity, thereby greatly improving the durability of shoes. If you do a good waterproof protection for electronic components, you can wash directly without fear of damaging electronic components.

Figure 5:
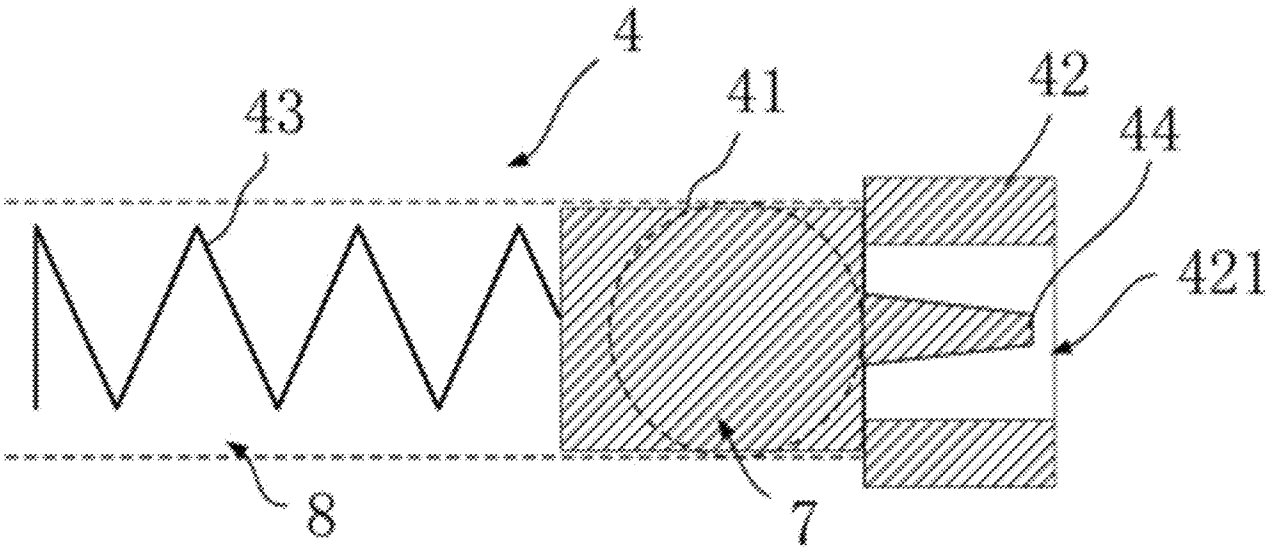
FIG. 5 is a schematic diagram of a closed state of a switch valve according to an embodiment of the present invention.

Referring to FIGS. 4 and 5, as an embodiment, the top end of the electromagnetic valve tongue 41 is provided with a negative ion generator 44, the magnetic valve seat is a ring 42;

As shown in FIG. 4, when the controller 2 controls the pressure generating device 1 to turn on the solenoid valve tongue 41 of the switch valve 4, the power supply of the negative ion generator 44 is simultaneously turned on, and the solenoid valve is opened. When the tongue 41 is the same as the magnetic pole of the magnetic valve seat 42 and is retracted by the repulsive force with the magnetic valve seat 42 to the side away from the magnetic valve seat 42, the negative ion generator 44 is in an operating state and is exactly in position. In the second passage 7, the air inside the shoes can be purified to prevent the interior of the shoes from deodorizing.

As shown in FIG. 5, the controller 2 controls the pressure power generating device 1 to stop supplying power to the solenoid valve tongue 41 of the switch valve 4, the power supply of the negative ion generator 44 is stopped simultaneously, and the electromagnetic valve tongue is stopped. When the spring mechanism (43) is pushed against the magnetic valve seat (42) side, the negative ion generator (44) is closed due to power off and is pushed into the annular center hole of the magnetic valve seat (42).

The above-mentioned switch valve 4 is simple and reliable in design, can guarantee long-term use, and is lighter in quality than electronic valves in the market, and can also effectively reduce costs.

Further, the controller 2 may also set two or more humidity thresholds according to the humidity detection result of the humidity sensor 3, and each humidity threshold corresponds to one adjustment position of the on/off valve 4. When the controller 2 determines that the humidity value detected by the humidity sensor 3 reaches a certain humidity threshold, the adjustment gear of the switch valve 4 is correspondingly found, and the voltage value (or current value) of the pressure generating device 1 is controlled, thereby changing the electromagnetic valve tongue. The magnetic flux of 41 causes the solenoid valve tongue 41 to stay in the position corresponding to the adjustment gear (for example, the second passage 7 is blocked by ⅓), thereby exerting the effect of fine adjustment of the air flow in the shoes chamber.

In addition, the controller 2 controls the pressure generating device 1 to turn on the power supply 41 of the solenoid valve of the switch valve 4, and after the second channel 7 is turned on, the controller 2 may further determine if the humidity value is lower than the threshold; it is further determined whether the difference between the current humidity value and the threshold is less than a predetermined amount. If yes, the controller controls the pressure generating device to stop supplying power to the solenoid valve tongue of the switch valve 4. The second channel is closed; otherwise it is not closed. In this way, the opening and closing of the opening and closing of the valve can be avoided too much, so as to avoid excessive interference to the user, and it is advantageous to delay the service life of the electronic component.

Further, as an embodiment, the first opening 61 of the first passage 6 is flared, and the inner diameter of the first passage 61 is gradually increased from the first passage 6 to the back of the heel, and the inner surface of the first opening 61 is a Coanda surface;

The third opening 71 between the second channel 7 and the chamber 5 is flared so that the inner diameter from the second channel 7 to the chamber 5 is gradually increased, and the second channel 7 and the second channel 7 are the inner surface of the third opening 71 between the chambers 5 is a Coanda surface.

In this way, the first opening 61 and the third opening are flared to effectively increase the amount of air intake in the shoes, and the first opening 61 is covered with a mesh fabric so that the first opening 61 is mesh-shaped so that dust can be prevented from entering the shoes. Further, the inner surface of the first opening 61 and the third opening 71 is designed as a Coanda surface, which acts as a guide for air flow, and further enhances the amount of air intake while enhancing the flow velocity and directionality of the air flow, thereby achieving a better heat dissipation effect.

Further, as an embodiment, the fourth opening 62 between the first passage 6 and the chamber 5 gradually shrinks the inner diameter from the first passage 6 to the chamber 5;

The second opening 72 is flared, the inner diameter of the upper surface of the arch portion (or the sole of the foot) from the second channel 7 to the insole gradually increases, and the inner surface of the second opening 72 is Coanda surface.

In this way, due to the design of the horn-shaped opening and the Coanda surface, combined with the contraction-shaped design of the fourth opening 62, the flow velocity is faster when entering the shoes cavity, and it effectively reduces the temperature during intense exercise.

In addition, a spiral slot line is provided inside the second channel 7. Through the design of the spiral groove line, when the airflow flows in the interior of the second channel 7, a rotation effect is generated. When the airflow is ejected from the second opening 72, the gas in the shoes cavity can be rapidly rotated to achieve better heat dissipation performance.

Further, as an example, all the electronic components and wires are wrapped or waterproofed with a waterproof material and firmly fixedly mounted. As an embodiment, the pressure generating device 1 and the controller 2 are placed in a waterproof protective sleeve, and both the bottom of the pressure generating device 1 and the controller 2 are fixedly connected to the inner bottom of the tank chamber 5;

The insole of the shoes body 100 includes an insulating layer and an exposed layer. The insulating layer is disposed under the exposed layer, and the insulating layer and the exposed layer have the same size. The optional insole is divided into two layers. The insulating layer can be sealed and fixed in the inner bottom of the shoes cavity and can not be disassembled. The exposed layer is a common insole placed over the insole with insulation layer.

Figure 6:
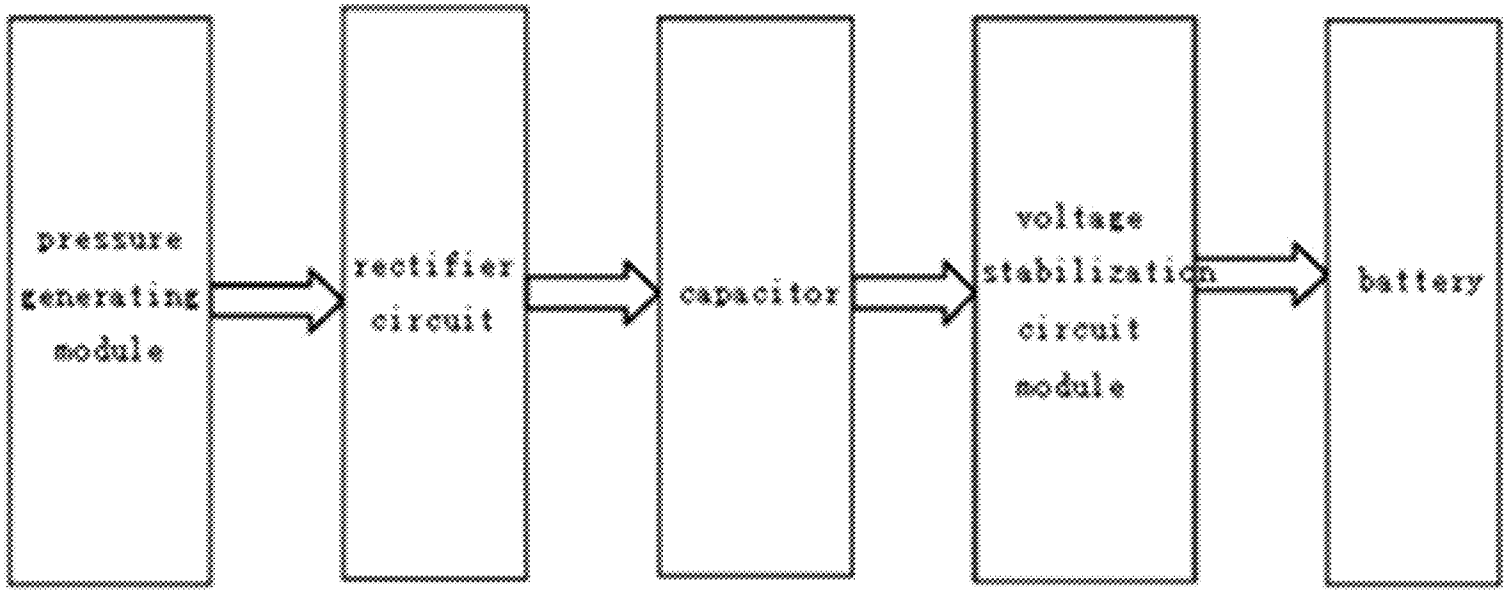
FIG. 6 is a schematic diagram of a circuit structure of a pressure generating apparatus according to an embodiment of the present invention.

Referring to FIG. 6, in a preferred embodiment of the present invention, the pressure power generating device 1 includes a pressure generating module, a rectifier circuit, a capacitor, and a voltage stabilization circuit module that are connected in series. In addition, a battery may also be included. The battery includes an energy storage and discharge circuit and a lithium battery. The energy storage and discharge circuit is electrically connected to a voltage stabilization circuit module and a lithium battery, respectively, for storing electrical energy in a lithium battery. The stored electrical energy is supplied to the controller, switch valve and humidity sensor.

The piezoelectric vibrator in the pressure generating module is under the alternating external force, and its voltage and current both exhibit alternating characteristics, so as to charge the battery, or power the controller 2, the humidity sensor 3 and the switch valve 4 (in the absence of In the case of a battery, both require a regulated DC, so they must be rectified by a rectifier circuit. The capacitor is used to store the electric energy generated by the pressure generating device to raise the voltage. A voltage tripler rectifier circuit can be designed to increase the output voltage as much as possible, and it is preferable to use a super capacitor. Finally, the voltage is regulated by the voltage regulator circuit module and the transient voltage is filtered and then output to the battery.

Figure 7:
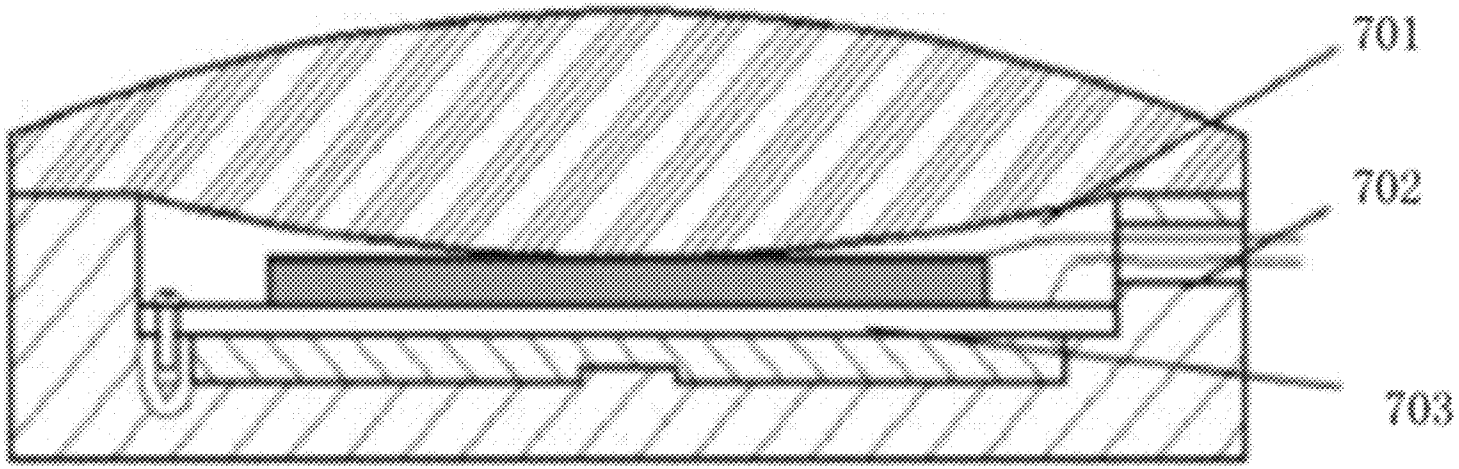
FIG. 7 is a schematic structural diagram of a pressure generating module according to an embodiment of the present invention.

Referring to FIG. 7, as one embodiment, the pressure generating module includes an upper elastic body 701, a lower housing 702, and a piezoelectric material 703. The piezoelectric material 703 is disposed between the upper elastic body 701 and the lower housing 702. The piezoelectric material 703 can optionally use piezoelectric ceramics, which can convert a very minute mechanical vibration displacement into electrical energy output. When walking, the heel presses the piezoelectric sheet of the sole, and the positive piezoelectric effect converts the pressure into electrical energy. The weight of the shoes with charging function can be reduced, and the required voltage and current can be obtained through multiple piezoelectric sheets connected in series or in parallel.

The pressure generating module in the above embodiment can also be replaced with other methods, such as: using a plurality of serrated power generation films; it can also be replaced with a power generation coil, so that the current generated by the power generation coil for cutting the magnetic force lines can be fully utilized as the power.

In this embodiment, the battery is a miniature battery and may include an energy storage and discharge circuit and a lithium battery. The energy storage and discharge circuit is electrically connected to a voltage stabilization circuit module and a lithium battery, respectively, for storing electric energy in lithium. Battery.

Figure 8A:
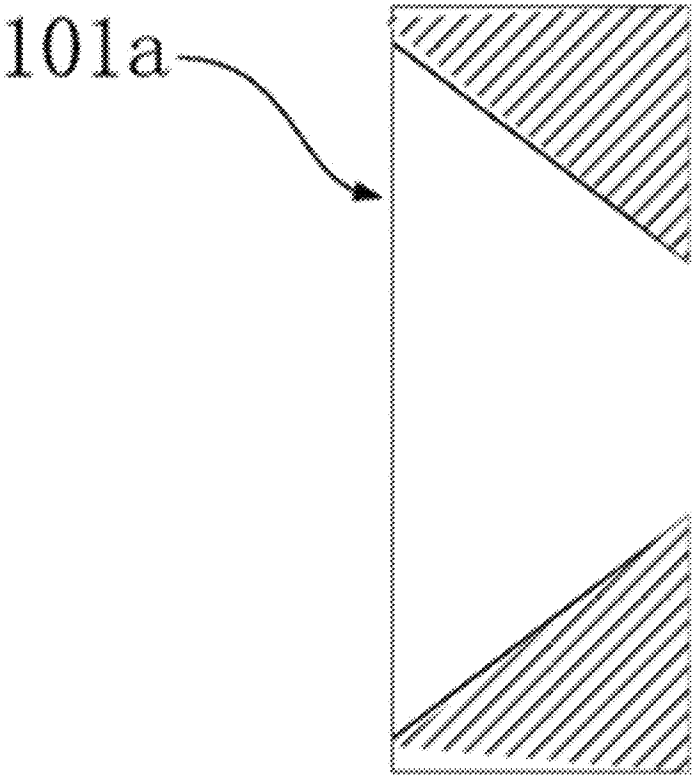
FIG. 8*a* is a schematic sectional view of a trapezoidal groove-shaped slide rail according to an embodiment of the present invention.
Figure 8B:
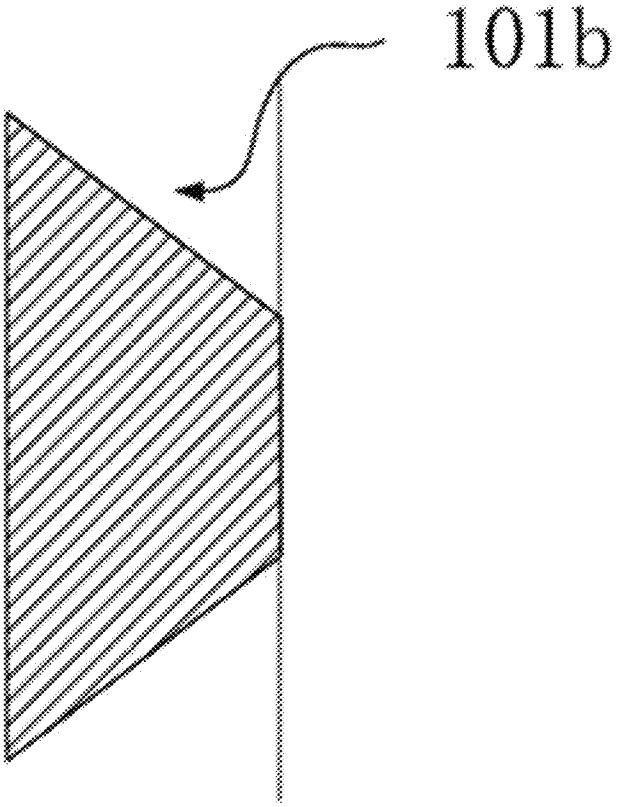
FIG. 8*b* is a schematic cross-sectional view of an inverted trapezoidal dome according to an embodiment of the present invention.

In addition, referring to FIG. 1, as an embodiment, a mutually fitting connection mechanism 101 may be provided on the front edge of the left and right shoes, respectively. Referring to FIGS. 8*a* and 8*b*, an inverted trapezoidal dome 101*b* may be provided at the front edge of one shoes body, and the front edge of the other shoes body is surrounded by the shape of the inverted trapezoidal dome. The slide rail 101*a* has a trapezoidal convex groove shape in cross section; the inverted trapezoidal convex wedge can be inserted into the trapezoidal convex groove from the side of the shoes body, and can slide in the convex groove shaped slide rail 101*a* to make two The front part of the shoes body is connected together, and when the inverted trapezoidal fin 101*b* slides to the front end of the shoes, the front ends of the two shoes are connected and the shoes tip is opposite, and the shoes can be used as a pillow when camping outdoors.

Optionally, as an embodiment, a wireless communication module such as Bluetooth or WIFI may also be disposed inside the shoes body of the sports shoes of the present invention. The wireless communication module is connected with the controller and is composed of the pressure generating device 1 or the pressure generating device. The battery in the power supply is used to communicate with an external device, receive a signal from an external device, and send it to the controller 2. The controller 2 controls the opening and closing of the opening and closing valve 4 according to an instruction of an external signal. Furthermore, a vibration device can be implanted in the shoes body and connected with the controller 2 and powered by the pressure generating device 1 or the battery in the pressure generating device. When the wireless communication module receives an external alarm instruction, it is transmitted to the control. The controller 2, the controller 2 controls the vibration device to vibrate the alarm. For example, when performing a sport, a malfunction occurs in a device, a fault hidden danger detection mechanism sends an alarm instruction to the wireless communication module through wireless communication, and after being transmitted to the controller 2, the controller 2 controls the vibration of the vibration device to make the user take precautionary measures in advance; or when a ball game plays a fierce confrontation match, the other player has signs of taking dangerous actions, or a foul has been required to suspend the game. The wireless control device in the hands of the coach or referee sends out a wireless alarm command. After the wireless communication module sends an alarm instruction and transmits the alarm instruction to the controller 2, the controller 2 controls the vibration device to vibrate the alarm so that the user can take precautions to prevent the danger from happening in advance, or call the user in this manner to make it. Stop the game.

In addition, by means of the wireless communication module, a control parameter setting instruction may also be received, and parameters such as the humidity value judgment threshold or the humidity threshold corresponding to the multi-range position may be modified according to individual requirements of the user so as to satisfy the requirement. Users' needs in different individuals or different environments.

As an embodiment, the sports shoes may further include: a pulse sensor and an alarm module; the pulse sensor is disposed inside the portion of the basketball shoes wrapped with the ankle, and is used for periodically detecting the pulse data of the detected ankle and the pulse frequency data sent to the controller, the controller determines whether the received pulse data is within a predetermined normal range, and if not, sends an alarm through the alarm module.

It should be understood by those of ordinary skill in the art that the discussion of any of the above embodiments is merely exemplary and is not intended to suggest that the scope of the present disclosure (including claims) is limited to these examples; under the concept of the present invention, the above embodiments may alternatively The technical features in different embodiments may also be combined, the steps may be implemented in any order, and there are many other variations of various aspects of the invention as described above, which are not provided in the details for the sake of brevity. Therefore, any omissions, modifications, equivalent replacements and improvements made within the spirit and principle of the present invention shall fall within the protection scope of the present invention.

We claim:

1. A pair of shoes comprising a shoe body, a pressure generating device, a humidity sensor, a controller and a switch valve, wherein the shoe body comprises a heel and an arch portion;

a groove cavity is provided at the heel;

the pressure generating device is arranged within the groove cavity;

the pressure generating device comprises a working part;

the working part is located at an upper part of the pressure generating device;

the shoe body comprises a shoe insole located inside the shoe body;

the shoe insole comprises a lower surface;

the working part of the pressure generating device is in contact with the lower surface of the shoe insole the shoe body further comprises a first opening provided at a back of the heel of the shoe body;

a first channel is opened between the groove cavity and the first opening a second opening is formed on the upper surface of the arch portion;

a mesh is provided at a corresponding position of the second opening of the shoe insole and a second channel is opened from the groove cavity to the second opening;

the first channel is conducted through the groove cavity and the second channel so that the outside air can enter into the shoe through the back of the heel;

the switch valve is disposed perpendicularly across the second channel;

the switch valve comprise an electromagnetic valve tongue, a magnetic valve seat, and a spring mechanism;

the electromagnetic valve tongue and the spring mechanism are disposed on the switch valve on one side of the second channel;

the magnetic valve seat is located on the opposite side of the electromagnetic valve tongue and the spring mechanism;

when the electromagnetic valve tongue is powered off, the electromagnetic valve tongue is pressed against the magnetic valve seat side by the spring mechanism;

the electromagnetic valve tongue blocks the second channel, so that the second channel is closed;

when the electromagnetic valve tongue is energized, the magnetic valve tongue is the same as a magnetic pole of the magnetic valve seat and receives a magnetic force;

repulsive force between the valve seats is retracted to a side away from the magnetic valve seat, so that the second channel is conducted;

an inner bottom of the shoe body is provided with the humidity sensor near the upper surface of the second opening and the controller is disposed in the groove cavity;

the humidity sensor, the controller and the switch valve are electrically connected in turn and the pressure generating device supplies power to the humidity sensor, controller and switch valve, respectively;

under normal circumstances, the controller controls the pressure generating device to stop supplying power to the electromagnetic valve tongue of the switch valve, enabling the second channel to close;

the humidity sensor detects ambient humidity changes and sends a humidity detection result to the controller the controller determines in real time whether humidity value exceeds a threshold; and if the threshold is exceeded, the controller controls the pressure generating device such that the electromagnetic value tongue of the switch valve is opened to power the second channel.

2. The shoes according to claim 1, wherein a negative ion generator is provided at a top of the electromagnetic valve tongue and the magnetic valve seat is annular;

when the controller controls the pressure generating device to turn on the electromagnetic valve tongue of the switch valve, the power supply of the negative ion generator is turned on at the same time and the electromagnetic valve tongue has the same magnetic pole as the magnetic valve seat;

when the repulsive force between the magnetic valve seat is retracted to the side remote from the magnetic valve seat, the negative ion generator is in the second channel; and when the controller controls the pressure generating device to stop powering the electromagnetic valve tongue of the switch valve, the power supply of the negative ion generator is stopped simultaneously; and when the electromagnetic valve tongue is pressed by the spring mechanism on one side of the magnetic valve seat, the negative ion generator is forced into the annular center hole of the magnetic valve seat.

3. The shoes according to claim 1, wherein the first opening is flared, an inner diameter gradually increases from the first channel to the back of the heel, and an inner surface of the first opening is a Coanda surface; and a third opening formed between the second channel and the groove cavity is flared, a diameter gradually increases from the second channel to the groove cavity, and an inner surface of the third opening is a Coanda surface.

4. The shoes according to claim 3, wherein a fourth opening between the first channel and the groove cavity gradually contracts from the first channel to an internal diameter of the groove cavity; and the second opening is flared, an inner diameter of an upper surface extending from the second channel to the insole portion gradually increases, and an inner surface of the second opening is a Coanda surface.

5. The shoes according to claim 1, wherein a spiral groove line is provided inside the second channel.

6. The shoes according to claim 1, wherein the pressure generating device and the controller are disposed in a waterproof protective sleeve whose bottom is fixedly connected to an interior bottom of the groove cavity;

the shoe insole comprises an insulating layer and an exposed layer;

the insulating layer is disposed under the exposed layer; and the insulating layer and the exposed layer have the same size.

7. The shoes according to claim 1, wherein the pressure generating device comprises a pressure generating module, a rectifier circuit, a capacitor and a voltage stabilization circuit module that are connected in series.

8. The shoes according to claim 7, wherein the pressure generating device further comprises a battery;

the battery comprises an energy storage and discharge circuit and a lithium battery; and the energy storage and the discharge circuit are electrically connected to the circuit module and the lithium battery, respectively, storing the electric energy in the lithium battery and supplying the stored electric energy to the controller, the switch valve and the humidity sensor.

9. The shoes according to claim 1, wherein the controller controls the pressure generating device to turn on the electromagnetic valve tongue of the switch valve to enable the following: if the controller determines that the humidity value is lower than the threshold, the second channel further determines whether the difference between the current humidity value and the threshold is less than a predetermined amount, and if yes, the controller controls the pressure generating device to stop the switch valve so that the solenoid valve electromagnetic valve tongue is energized to close the second channel.

10. The shoes according to claim 1, wherein a cross-shaped trapezoid is provided at a front edge of one shoe body and a front edge of the other shoe body is surrounded by an inverted trapezoid;

the cross-section of a convex cymbal shape matching is a trapezoidal groove-shaped slide rail; and the inverted trapezoidal convex ridge can be inserted into the trapezoidal convex groove from a lateral side of the shoes body and can slide in the convex groove-shaped slide rail, connecting the front of the two shoes together.

* * * * *